US009757613B2

(12) United States Patent
Miller

(10) Patent No.: US 9,757,613 B2
(45) Date of Patent: Sep. 12, 2017

(54) ELLIPTICAL EXERCISE DEVICE WITH CAM DRIVE

(71) Applicant: Larry D. Miller, Rochester, MI (US)

(72) Inventor: Larry D. Miller, Rochester, MI (US)

(73) Assignee: Larry D. Miller Trust, Rochester, MI (US)

( * ) Notice: Subject to any disclaimer, the term of this patent is extended or adjusted under 35 U.S.C. 154(b) by 0 days.

(21) Appl. No.: 15/009,127

(22) Filed: Jan. 28, 2016

(65) Prior Publication Data

US 2016/0151663 A1 Jun. 2, 2016

Related U.S. Application Data

(63) Continuation-in-part of application No. PCT/US2015/034146, filed on Jun. 4, 2015, which is (Continued)

(51) Int. Cl.
*A63B 22/06* (2006.01)
*A63B 22/00* (2006.01)
(Continued)

(52) U.S. Cl.
CPC .... *A63B 22/0664* (2013.01); *A63B 21/00069* (2013.01); *A63B 21/151* (2013.01); *A63B 21/4034* (2015.10); *A63B 21/4035* (2015.10); *A63B 21/4049* (2015.10); *A63B 22/001* (2013.01); *A63B 22/0015* (2013.01); *A63B 22/0017* (2015.10); *A63B 22/0056* (2013.01); *A63B 22/04* (2013.01); *A63B 23/03591* (2013.01); *A63B 21/005* (2013.01); *A63B 21/015* (2013.01); *A63B 21/154* (2013.01); *A63B 21/225* (2013.01); *A63B 24/0087* (2013.01); *A63B 2022/002* (2013.01); *A63B 2022/0676* (2013.01); *A63B 2022/0682* (2013.01); *A63B 2220/803* (2013.01)

(58) Field of Classification Search
USPC ..... 482/1–148
See application file for complete search history.

(56) References Cited

U.S. PATENT DOCUMENTS 5,577,985 A 11/1996 Miller
5,611,756 A 3/1997 Miller
(Continued)

FOREIGN PATENT DOCUMENTS

AU 2007202574 A1 1/2009

*Primary Examiner* — Stephen Crow
(74) *Attorney, Agent, or Firm* — Dinsmore & Shohl LLP

(57) ABSTRACT

An elliptical exercise device has a frame and guide link pivotally attached thereto. A foot support link is pivotally connected to a lower attachment point of each guide link so that when the guide links pivot relative to the frame, foot receiving areas of the foot support links move in a path of travel having a horizontal component of motion. A cam drive has cams supported for rotation about an axis of rotation and pivoting arms each engaging one of the cams such that rotation of the cams causes movement of the pivoting arms. Flexible elements couple the foot support links to the pivoting arms such that rotation of the cams moves the foot receiving areas of the respective foot support links in a path of travel having a vertical component of motion.

22 Claims, 12 Drawing Sheets

Related U.S. Application Data a continuation of application No. 14/643,587, filed on Mar. 10, 2015, now Pat. No. 9,072,936, and a continuation of application No. 14/643,522, filed on Mar. 10, 2015, now Pat. No. 9,061,175.

(60) Provisional application No. 62/243,796, filed on Oct. 20, 2015, provisional application No. 62/086,470, filed on Dec. 2, 2014.

(51) Int. Cl.

| | |
|---|---|
| ***A63B 21/00*** | (2006.01) |
| ***A63B 22/04*** | (2006.01) |
| ***A63B 23/035*** | (2006.01) |
| *A63B 21/005* | (2006.01) |
| *A63B 21/015* | (2006.01) |
| *A63B 21/22* | (2006.01) |
| *A63B 24/00* | (2006.01) |

(56) References Cited

U.S. PATENT DOCUMENTS

| | | | | |
|---|---|---|---|---|
| 5,788,610 | A | 8/1998 | Eschenbach | |
| 5,911,649 | A | 6/1999 | Miller | |
| 6,019,710 | A | 2/2000 | Dalebout et al. | |
| 6,045,487 | A | 4/2000 | Miller | |
| 6,113,518 | A | 9/2000 | Maresh et al. | |
| 6,126,574 | A | 10/2000 | Stearns et al. | |
| 6,689,119 | B1 | 2/2004 | Di Caprio et al. | |
| 6,758,790 | B1 | 7/2004 | Ellis | |
| 6,929,587 | B2 | 8/2005 | Charnitski | |
| 7,052,438 | B2 | 5/2006 | Eschenbach | |
| 7,101,316 | B2 | 9/2006 | Rosenow et al. | |
| 7,160,230 | B2 | 1/2007 | Tremblay | |
| 7,169,089 | B2 | 1/2007 | Rodgers, Jr. | |
| 7,169,090 | B1 | 1/2007 | Maresh | |
| 7,462,134 | B2 | 12/2008 | Lull et al. | |
| 7,556,591 | B2 | 7/2009 | Chuang et al. | |
| 7,591,761 | B1 | 9/2009 | Ellis | |
| 7,651,445 | B1 | 1/2010 | Chen | |
| 7,678,025 | B2 | 3/2010 | Rodgers, Jr. | |
| 7,708,668 | B2 | 5/2010 | Rodgers, Jr. | |
| 7,749,137 | B2 | 7/2010 | Watt et al. | |
| 7,758,473 | B2 | 7/2010 | Lull et al. | |
| 7,794,362 | B2 | 9/2010 | Miller | |
| 7,828,698 | B2 | 11/2010 | Rodgers, Jr. | |
| 7,841,968 | B1 | 11/2010 | Eschenbach | |
| 7,938,754 | B2 | 5/2011 | Eschenbach | |
| 8,029,416 | B2 | 10/2011 | Eschenbach | |
| 8,092,351 | B1 * | 1/2012 | Rodgers, Jr. ..... | A63B 21/00181 482/51 |
| 8,133,159 | B2 | 3/2012 | Eschenbach | |
| 8,303,470 | B2 | 11/2012 | Stewart et al. | |
| 8,317,663 | B2 | 11/2012 | Stewart et al. | |
| 8,597,161 | B2 | 12/2013 | Dibble et al. | |
| 8,663,072 | B2 | 3/2014 | Stewart et al. | |
| 8,668,627 | B2 | 3/2014 | Eschenbach | |
| 8,740,754 | B2 | 6/2014 | Miller | |
| 8,979,714 | B2 | 3/2015 | Miller | |
| 9,061,175 | B1 | 6/2015 | Miller et al. | |
| 9,192,809 | B1 * | 11/2015 | Miller ..... | A63B 21/0087 |
| 2001/0016541 | A1 | 8/2001 | Maresh et al. | |
| 2006/0172865 | A1 | 8/2006 | Dey et al. | |
| 2012/0108402 | A1 | 5/2012 | Rodgers, Jr. | |
| 2013/0012363 | A1 | 1/2013 | Eschenbach | |
| 2014/0148311 | A1 | 5/2014 | Eschenbach | |
| 2014/0296036 | A1 | 10/2014 | Miller | |
| 2014/0336006 | A1 | 11/2014 | Miller | |

* cited by examiner

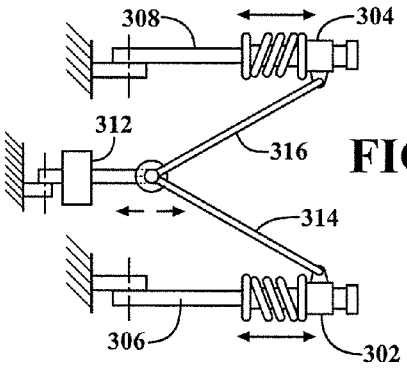
FIG. 11
FIG. 10
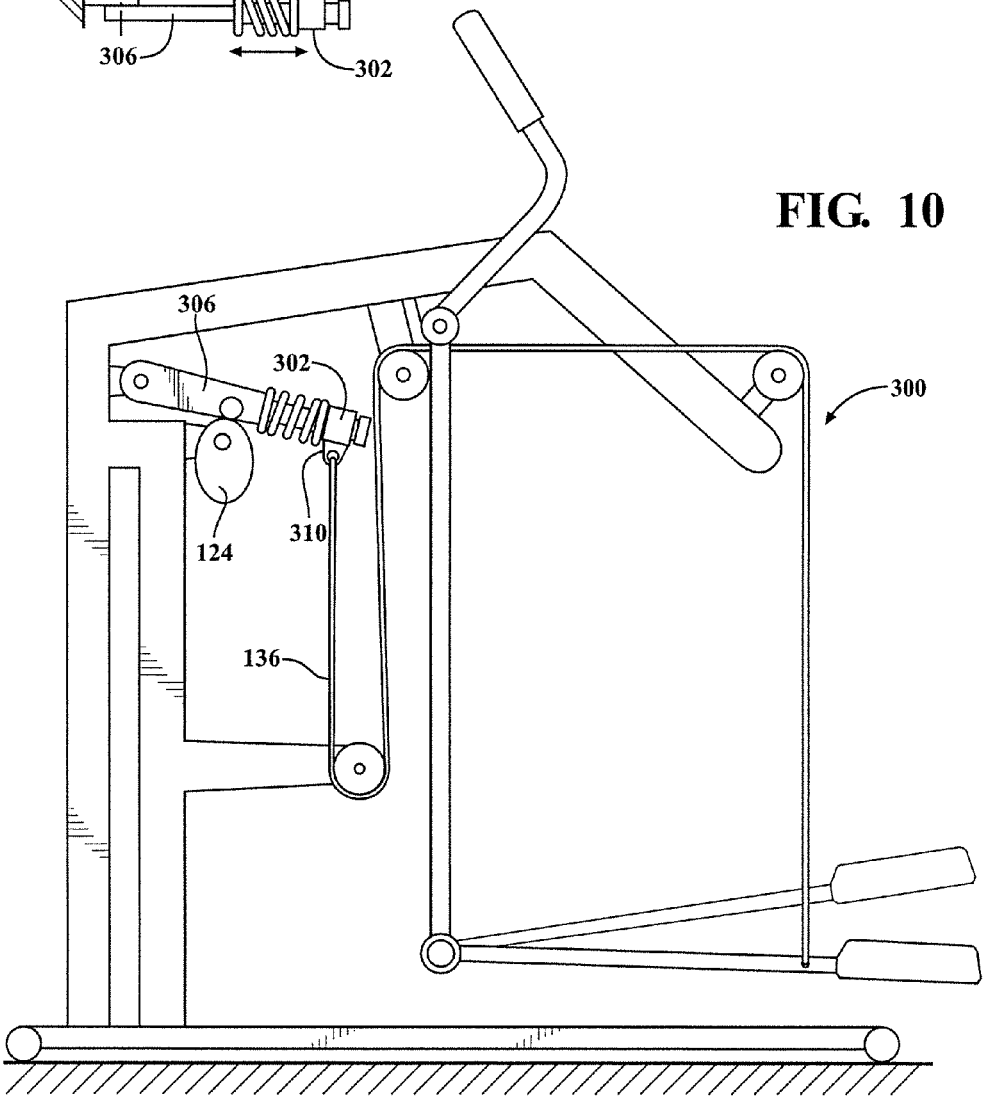

ELLIPTICAL EXERCISE DEVICE WITH CAM DRIVE

CROSS-REFERENCE TO RELATED APPLICATIONS

This application claims priority to U.S. provisional patent application Ser. No. 62/243,796, filed Oct. 20, 2015. This application is also a continuation-in-part of international patent application Serial No. PCT/US2015/034146, filed Jun. 4, 2015, which claims priority to 62/086,470, filed Dec. 2, 2014, U.S. patent application Ser. No. 14/643,587, filed Mar. 10, 2015, and U.S. patent application Ser. No. 14/643,522, filed Mar. 10, 2015. The contents of all of which are incorporated herein in their entirety.

FIELD OF THE INVENTION

This invention relates to elliptical exercise devices in which the path of travel of a user's foot is generally elliptical.

BACKGROUND OF THE INVENTION

There are a number of exercise devices that operate to allow a user to implement a foot action following a generally closed, curved path of travel, simulating running and/or walking. These devices are generally referred to as "elliptical" exercise devices. Many such elliptical exercise devices are large, complicated, costly, and/or have undesirable characteristics related to the motion of the user's feet.

U.S. Pat. No. 5,518,473 to Miller shows an early design for an elliptical exercise device. The device provides a path of travel that simulates running and/or walking but is quite large and does not provide for arm exercise.

U.S. Pat. No. 5,611,756 to Miller discloses an elliptical exercise device with arm and leg movement. A pair of guide links are pivotally supported on a frame and a foot engaging link is supported at the lower end of each guide link. An intermediate link connects each guide link to crank. A control link joins each foot link to the corresponding intermediate link to vary the angle of the foot link relative to the guide link.

U.S. Pat. No. 6,045,487 to Miller discloses an elliptical exercise device having a pair of guide links pivotally supported on a frame and a foot link supported at the lower end of each guide link. An intermediate link connects each guide link to a crank of a crank system. A flexible control member engages each foot link and extends up and over a pulley located at the guide link pivot axis. The control members connect to a reciprocating assembly for moving the foot links up and down as the guide links pivot back and forth.

U.S. Pat. No. 7,708,668 to Rodgers, Jr. shows several embodiments of an exercise device having flexible elements coupling left and right foot support members to a crank system. The exercise device allows for a variable stride length and decouples the vertical and horizontal components of foot travel.

U.S. Pat. No. 7,556,591 to Chuang et al. discloses an exercise device with cranks mounted to an upper portion of a frame. Two handles are pivoted to the frame forward of the cranks. Foot supports are pivotally coupled to the lower ends of the handles. Pivot rods extend between each foot support and one of the cranks. Additional links connect each handle with the same cranks as the respective pivot rod.

SUMMARY OF THE INVENTION

The present invention offers several embodiments of an elliptical exercise device. Some embodiments offer a path of motion with desirable characteristics. In addition, some embodiments are compact in form and have reduced mechanical complexity.

A first embodiment of an elliptical exercise device includes a frame configured to be supported on a horizontal surface. The frame has a first pivot defined thereon, a forward portion forward of the first pivot axis and a rearward portion rearward of the first pivot axis. A first and a second guide link each having a first and a second attachment point defined thereon, each guide link being pivotally attached, through its first attachment point, to the frame at the first pivot axis thereof, and each of the guide links having a guide length defined between the first and second attachment point. A first and a second foot support link each having a foot receiving area configured to support a user's foot thereupon. Each foot support link is pivotally connected to the second attachment point of a respective one of the guide links so that when the guide links pivot relative to the frame, they each cause the respective foot receiving area to move in a path of travel having a horizontal component of motion. Each foot support link also has a coupling point rearward of the respective pivotal connection to the respective guide link. A cam drive has a first and second cam supported for rotation about an axis of rotation and a first and a second pivoting arm engaging the respective first and second cams such that rotation of the cams causes movement of the pivoting arms. A first and a second vertical control guide are disposed on the rearward portion of the frame, spaced from the first pivot axis. A first and a second flexible element each couple a respective one of the foot support links to a respective one of the pivoting arms of the cam drive. Each flexible element has a first end connected to a respective one of the pivoting arms, a second end connected to the coupling point on the respective foot support link, and a midportion extending over a respective one of the vertical control guides on the frame such that rotation of the cams moves the foot receiving areas of the respective foot support links in a path of travel having a vertical component of motion. Each of the flexible couplings has a foot support portion extending between the coupling point on the respective foot support link and the respective vertical guide on the frame, the foot support portion being generally parallel to the respective guide link throughout the motion of the device, the foot support portion further having a length that is similar to the guide length when the respective foot support link is at a midpoint of vertical travel. The respective first attachment point, second attachment point, vertical control guide on the frame and coupling point on the foot support portion generally define a parallelogram when the respective foot support link is at the midpoint of vertical travel. The pivotal motion of the guide links about the first attachment points is decoupled from the motion of the foot receiving areas along the path of travel having a vertical component of motion so that the user can achieve a foot path that is generally vertical or a blend of vertical and horizontal motion.

In some versions, the vertical control guides are spaced from the first pivot axis by a distance of 6 or more inches. In certain versions, each of the cams has a generally non-circular shape. In some versions, the guide links further include hand portions extending upwardly from the first attachment point. In some versions, a forward end of each foot support link is pivotally interconnected with the second attachment point of the respective guide link, a rearward end of each foot support link defines the foot receiving area, and the coupling point on each foot support link is defined between the forward and rearward ends.

In some versions, the pivoting arms each have a pivot end, an opposite control end, and a midportion therebetween, the pivot arms each further having a follower connected to the midportion, each follower contacting an outer surface of a respective one of the cams. The first end of each of the flexible elements is connected to the control end of the respective one of the pivoting arms. In certain alternatives, each pivoting arm is generally horizontal with the pivot end being forward of the control end, and each flexible element extends generally vertically from the control end of the respective pivoting arm. In this alternative, the exercise device may also have a first and second forward pulley and a first and second lower pulley, each flexible element extending downwardly from the first end, wrapping under the respective lower pulley, extending upwardly and wrapping over the forward pulley, and extending rearwardly to the respective vertical control guide. In certain other alternatives, each pivoting arm is generally vertical with the pivot end being lower than the control end, and each flexible element extends generally horizontally and rearwardly from the control end of the respective pivoting arm.

In some versions, the exercise device also has a horizontal coordination linkage linking the first guide link to the second guide link such that pivotal movement of one of the guide links in a first direction causes pivotal movement of the other of the guide lines in an opposite direction.

In certain versions, each vertical control guide comprises a pulley rotationally mounted on the frame In some versions, the exercise device also has an adjustment mechanism for adjusting a range of vertical travel, the adjustment mechanism having a first sliding collar coupled to the first pivoting arm and a second sliding collar coupled to the second pivoting arm. The first end of each of the flexible elements is coupled to the sliding collar of the respective pivoting arm. The adjustment mechanism also includes an actuator operable to move the sliding collars on the pivoting arms.

In some versions, the flexible element are cables.

Another embodiment of an elliptical exercise device includes a frame configured to be supported on a horizontal surface. The frame has a first pivot defined thereon, a forward portion forward of the first pivot axis and a rearward portion rearward of the first pivot axis. A first and a second guide link each having a first and a second attachment point defined thereon, each guide link being pivotally attached, through its first attachment point, to the frame at the first pivot axis thereof, and each of the guide links having a guide length defined between the first and second attachment point. A first and a second foot support link each having a foot receiving area configured to support a user's foot thereupon. Each foot support link is pivotally connected to the second attachment point of a respective one of the guide links so that when the guide links pivot relative to the frame, they each cause the respective foot receiving area to move in a path of travel having a horizontal component of motion. Each foot support link also has a coupling point rearward of the respective pivotal connection to the respective guide link. A cam drive has a first and second cam supported for rotation about an axis of rotation and a first and a second pivoting arm engaging the respective first and second cams such that rotation of the cams causes movement of the pivoting arms. A first and a second vertical control guide are disposed on the rearward portion of the frame, spaced from the first pivot axis by a distance of 6 or more inches. A first and a second flexible element each couple a respective one of the foot support links to a respective one of the pivoting arms of the cam drive. Each flexible element has a first end connected to a respective one of the pivoting arms, a second end connected to the coupling point on the respective foot support link, and a midportion extending over a respective one of the vertical control guides on the frame such that rotation of the cams moves the foot receiving areas of the respective foot support links in a path of travel having a vertical component of motion. The pivotal motion of the guide links about the first attachment points is decoupled from the motion of the foot receiving areas along the path of travel having a vertical component of motion so that the user can achieve a foot path that is generally vertical or a blend of vertical and horizontal motion.

In some versions, each of the cams has a generally non-circular shape. In some versions, the guide links further include hand portions extending upwardly from the first attachment point. In some versions, a forward end of each foot support link is pivotally interconnected with the second attachment point of the respective guide link, a rearward end of each foot support link defines the foot receiving area, and the coupling point on each foot support link is defined between the forward and rearward ends.

In some versions, the pivoting arms each have a pivot end, an opposite control end, and a midportion therebetween, the pivot arms each further having a follower connected to the midportion, each follower contacting an outer surface of a respective one of the cams. The first end of each of the flexible elements is connected to the control end of the respective one of the pivoting arms. In certain alternatives, each pivoting arm is generally horizontal with the pivot end being forward of the control end, and each flexible element extends generally vertically from the control end of the respective pivoting arm. In this alternative, the exercise device may also have a first and second forward pulley and a first and second lower pulley, each flexible element extending downwardly from the first end, wrapping under the respective lower pulley, extending upwardly and wrapping over the forward pulley, and extending rearwardly to the respective vertical control guide. In certain other alternatives, each pivoting arm is generally vertical with the pivot end being lower than the control end, and each flexible element extends generally horizontally and rearwardly from the control end of the respective pivoting arm.

In some versions, the exercise device also has a horizontal coordination linkage linking the first guide link to the second guide link such that pivotal movement of one of the guide links in a first direction causes pivotal movement of the other of the guide lines in an opposite direction.

In certain versions, each vertical control guide comprises a pulley rotationally mounted on the frame In some versions, the exercise device also has an adjustment mechanism for adjusting a range of vertical travel, the adjustment mechanism having a first sliding collar coupled to the first pivoting arm and a second sliding collar coupled to the second pivoting arm. The first end of each of the flexible elements is coupled to the sliding collar of the respective pivoting arm. The adjustment mechanism also includes an actuator operable to move the sliding collars on the pivoting arms.

In some versions, the flexible element are cables.

As will be clear to those of skill in the art, the various elements, details and variations illustrated and discussed with respect to particular embodiments may be combined in different ways and used with other embodiments, in any combination.

BRIEF DESCRIPTION OF THE DRAWINGS

FIG. 10 is a side elevational view of a further embodiment of an exercise device with an adjustment mechanism for adjusting the vertical travel of the stride path;

FIG. 11 is a top view of the adjustment mechanism for the embodiment of FIG. 10;

DETAILED DESCRIPTION OF THE PREFERRED EMBODIMENTS

Figure 1:
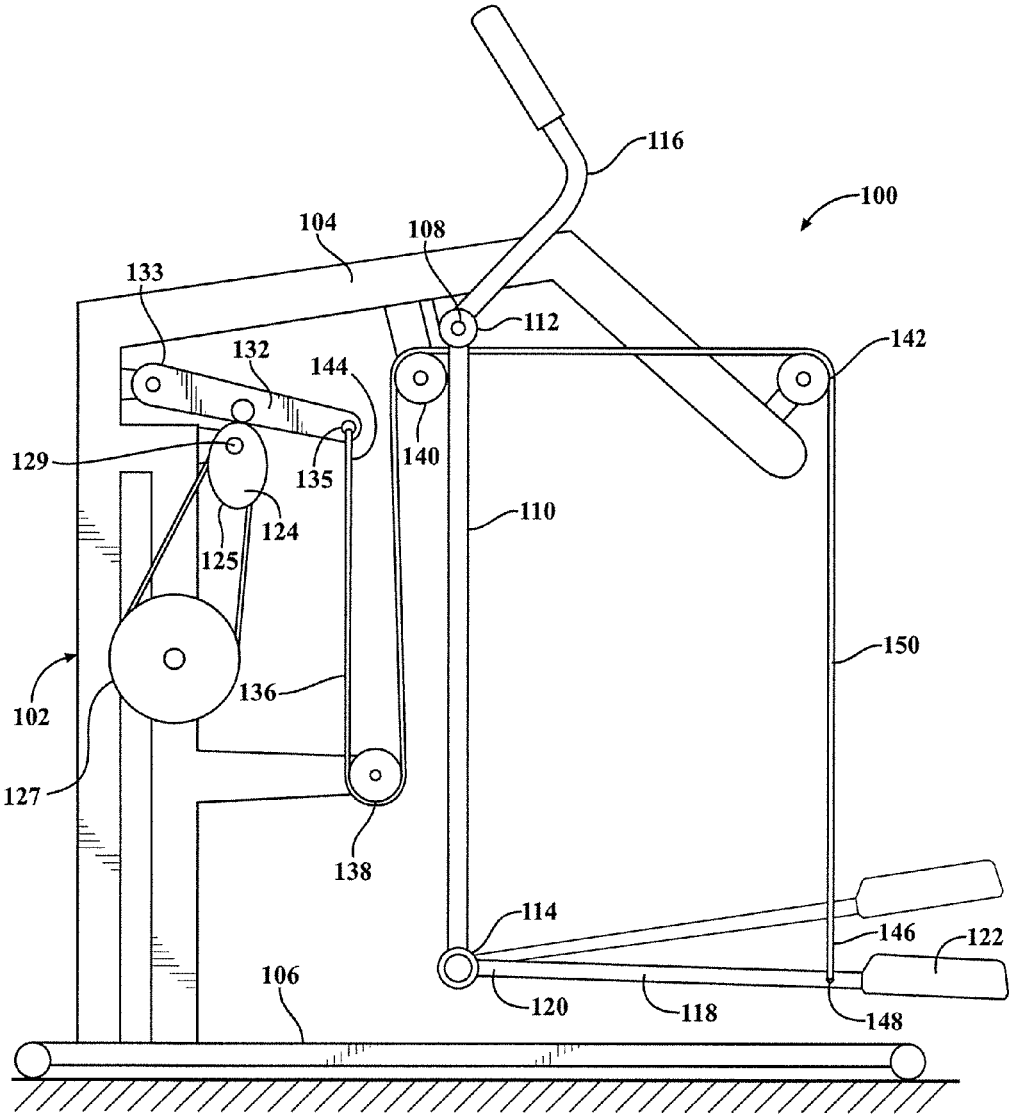
FIG. 1 is a side elevational view of a first embodiment of an elliptical exercise device in accordance with the present invention.

The present invention will be explained with reference to several particular embodiments, including variations and optional features of these embodiments. It is to be understood that yet other embodiments, modifications, and variations thereof will be apparent to those of skill in the art in view of the teaching presented herein. Further, features and elements of certain embodiments may be combined with each other in combinations other than those illustrated, and variations and optional features may be used with any of the embodiments.

The present invention relates to exercise devices which are often referred to as elliptical exercise devices. An elliptical exercise device is designed to be used by a user placing their feet on respective foot receiving areas and then moving their feet along a generally elliptical path. This path will have horizontal and vertical components. The term "elliptical exercise device" is used herein in its broad sense to include both free stride exercise devices and fixed path exercise devices.

In a free stride exercise device, the motion of the foot receiving areas along a path of travel having a horizontal component of motion is generally decoupled from motion of the foot receiving areas along a path of travel having a vertical component of motion. Typically, a free stride exercise device will allow a user to alter the length of the horizontal path of travel by exerting more or less fore-aft force to the foot receiving areas or associated hand grip areas. Typically, such a device will have a coordination linkage that coordinates the horizontal travel such that as one foot receiving area moves rearwardly, the other foot receiving area moves forwardly by an equal amount. Typically, a resistance element is also provided to provide resistance to the horizontal motion, though this is not mandatory. In a free stride device, the vertical motion is typically controlled by some type of vertical drive system that is coupled to the foot receiving areas and causes the foot receiving areas to oscillate upwardly and downwardly by a predetermined amount. The height of the vertical travel may or may not be adjustable. In some free stride devices, the path of travel may be adjusted so as to be primarily horizontal so as to mimic a striding or cross-country skiing motion, primarily vertical so as to mimic a climbing motion, or a combination of horizontal and vertical such that the foot receiving areas travel along a curved generally elliptical path. The term "generally elliptical" is intended to mean any curved path and is not limited to a strictly mathematical ellipse.

A fixed path elliptical exercise device is one in which the foot receiving areas travel along a path that is determined by the device rather than by the amount of force applied by the user. The amount of horizontal or vertical travel may be non-adjustable such that the foot receiving areas travel through a single predetermined path. Alternatively, the horizontal or the vertical travel, or both, may be adjustable so as to change the length, height, and/or shape of the elliptical path. In some embodiments, the present invention may also be useful as a stepper or striding type exercise device that may not typically be considered an elliptical exercise device.

Embodiments of the present invention make use of cams to control vertical motion of the foot receiving areas of the exercise device. A cam converts rotary motion to linear or reciprocating motion or vice versa.

Figure 2:
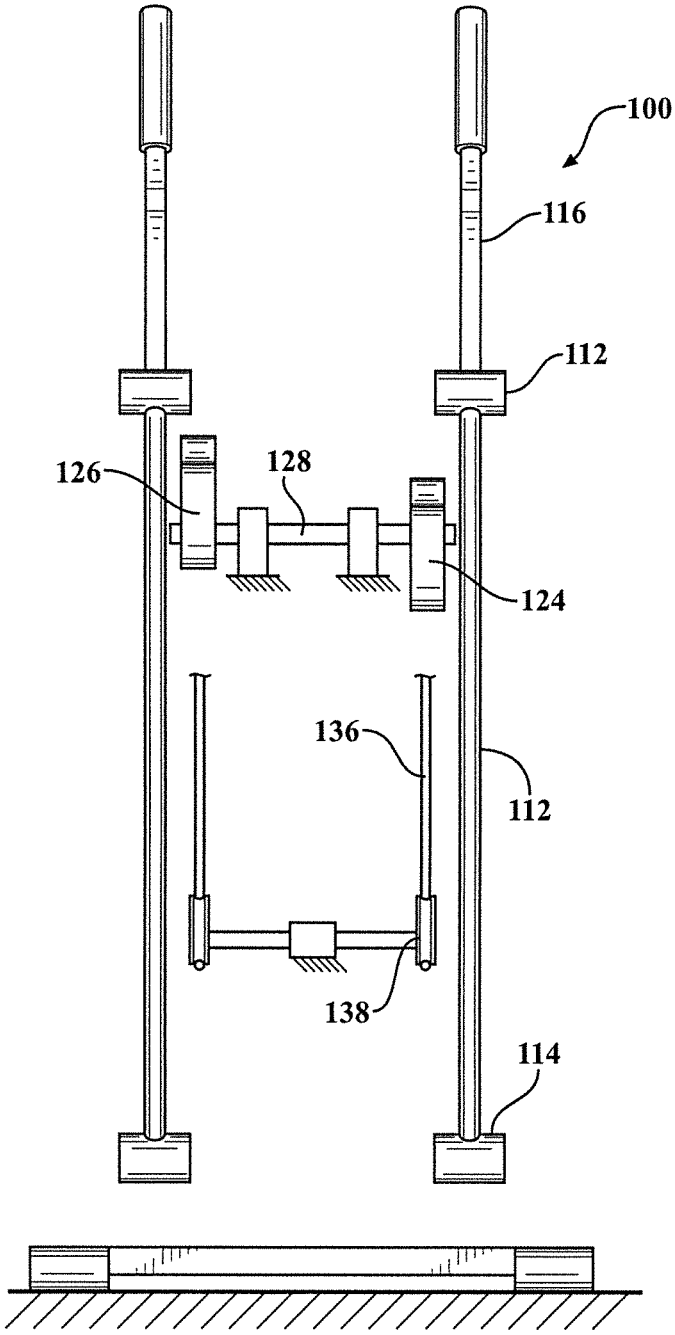
FIG. 2 is a front view of some components of the embodiment of FIG. 1.
Figure 5:
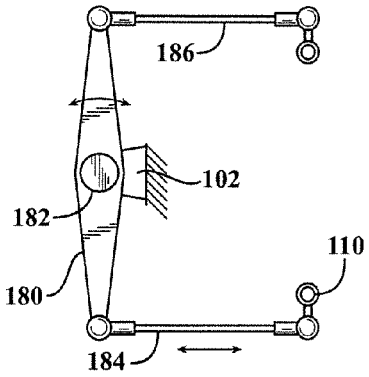
FIG. 5 is a top view of a horizontal control mechanism by itself.
Figure 4:
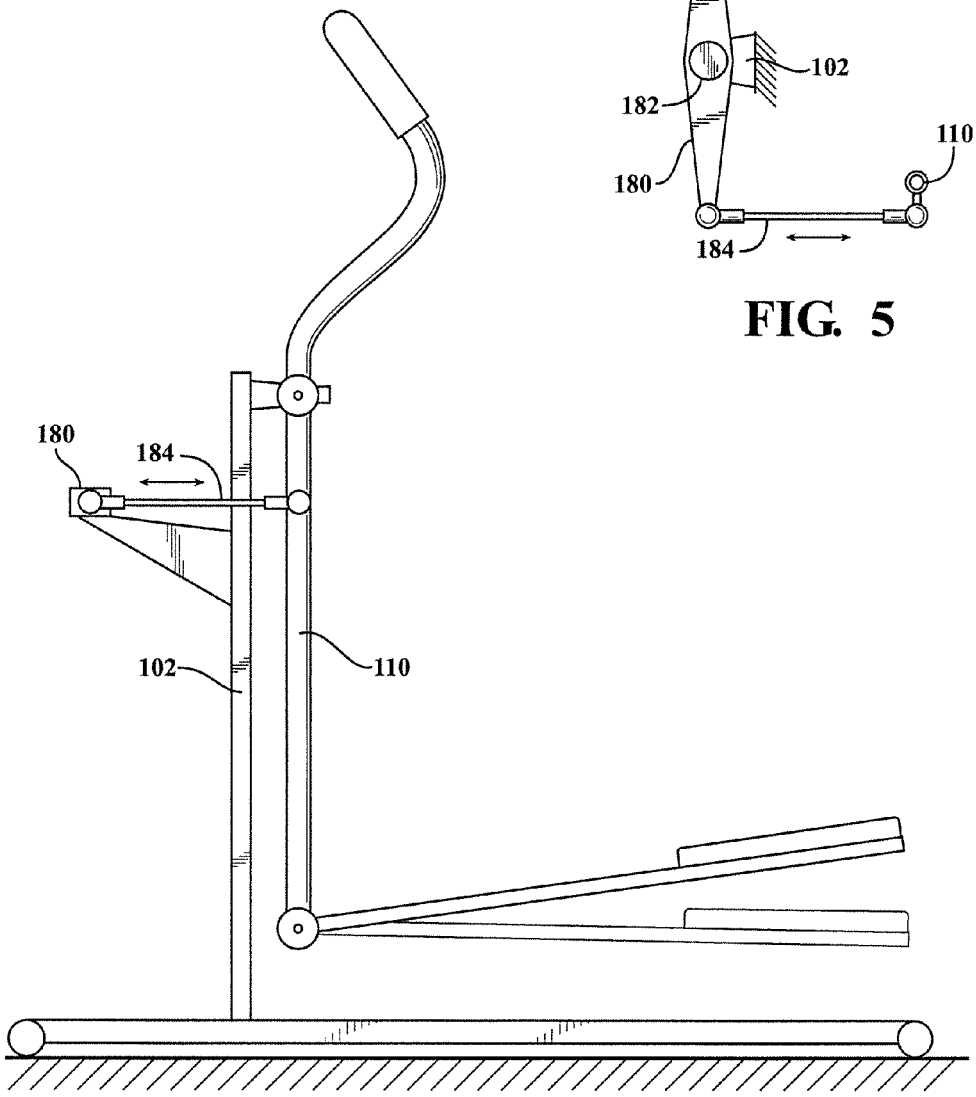
FIG. 4 is side elevational view of a portion of an exercise device, with the vertical control mechanism removed to simplify the drawing.

FIGS. 1 and 2 are side and front views, respectively, showing the basic layout of a free stride version of an elliptical exercise device 100, in which the extent of horizontal motion is controlled by the user. However, the device 100 may be modified to include a horizontal control system from one of the other embodiments in order to convert the device into a fixed path device. Various components are not shown in some of the views, to simplify the drawings. FIGS. 4 and 5 show additional components that may be included in the device 100.

The illustrated device 100 includes a frame 102 which is configured and operative to retain and support the various other components of the device on a horizontal surface such as a floor. The frame 102 is typically fabricated from metal and/or composite materials, but any material may be used. The frame 102 may take a variety of shapes and forms, other than shown, as long as it provides support for the components of the device. The frame 102 has an upper portion 104 and a lower portion 106. The lower portion 106 is configured to contact the horizontal surface while the upper portion 104 supports several components of the device. A first pivot axis 108 is defined in the upper portion 104 of the frame 102. The frame 102 may be said to have a forward portion forward of the first pivot axis 108, which is to the left in the view of FIG. 1, and a rearward portion rearward of the first pivot axis 108, which is to the right in the view of FIG. 1. As will be clear to those of skill in the art, exercise devices such as those described herein include left and right elements for supporting the respective left foot and right foot of the user. The right and left components of the device are typically substantially the same, though the device may be constructed such that the two foot receiving areas are 180 degrees out of phase. That is, when one foot receiving area is moving forwardly and/or downwardly, the other foot receiving area is moving rearwardly and/or upwardly. The embodiments of the present invention will be described primarily with reference to only one set of components, with it being understood that the corresponding components of the other half of the device are constructed similarly. FIG. 1 shows a side view of the device 100 with the left elements most visible.

A pair of guide links are pivotally interconnected with the frame so as to be pivotal about the first pivot axis 108. The left guide link 110 is shown at the midpoint of its travel with the right guide link hidden behind it. All left and right components may alternatively be referred to as first and second components for ease of description. The guide link 110 may be said to have a first attachment point 112 towards its upper end and a second attachment point 114 at its lower end. The guide link 110 is pivotally interconnected with the first pivot axis 108 of the frame 102 at its first attachment point 112. In the illustrated embodiment, the guide link 110 further includes a hand portion 116 that extends upwardly from the first attachment point 112. Each guide link 110 has a corresponding foot support link 118 pivotally connected thereto. In the illustrated embodiment, the foot support link 118 has a forward end 120 that is pivotally interconnected with the second attachment point 114 of the guide link 110. The foot support link 118 further has a foot receiving area 122 defined at its rearward end. FIG. 2 is a front view of some components of the device 100 and both guide links are visible.

Referring to FIGS. 1 and 2, two cams 124 and 126 are attached to a shaft 128 so as to be supported for rotation about a cam axis 129. As shown, the cams are orientated 180 degrees apart. A flywheel and resistance element 127 may be coupled to or associated with the shaft or otherwise interconnected with the moving parts so as to provide momentum and/or resistance. A left pivoting arm 132 and a right pivoting arm are oscillated by the respective cams. The arm 132 may be said to have a pivot end 133 that is pivotally attached to the frame and an opposite control end 135. A cam follower 134 is provided in a midportion of the pivoting arm 132. The cam 124 may be said to have an outer cam surface 125 and the cam follower 134 engages the cam surface 125, causing the arm 132 to pivot about its pivot end 133. In this version, the pivoting arm 132 is generally horizontally disposed with the pivot end 133 at the forward end and the control end 135 at the rearward end. As the cam 125 rotates, the control end 135 oscillates upwardly and downwardly.

A flexible element 136 couples the control end 135 of the pivoting arm 132 to the foot support link 118 such that rotation of cam 124 causes up and down motion of the foot support link 118. The flexible element 136 may couple the arm to the support link in a variety of ways. The flexible element may be a cable or other flexible element capable of coupling the respective components. In the illustrated embodiment, a lower pulley 138 is pivotally attached to the forward portion of the frame below the control end 135 of the arm 132. A forward pulley 140 is pivotally attached to the forward portion of the frame just below the first pivot axis 108. A vertical control guide 142, in the form of another pulley, is connected to the rearward portion of the frame at approximately the same vertical height as the forward pulley 140. The flexible element 136 has a first end 144 connected to the control end 135 of the pivoting arm 132. The flexible element 136 extends downwardly from the first end 144, wraps under the lower pulley 138, then extends upwardly to wrap over the forward pulley, then extends rearwardly to wrap over the vertical control guide, and then extends downwardly to a second end 146 that is attached to the foot support link 118 at a coupling point 148.

In this version, the portion of the flexible element 136 extending between the first end 144 and the lower pulley 138 and the portion between the lower pulley 138 and forward pulley 140 are both generally vertical and the portion between the forward pulley 140 and vertical control guide 142 is generally horizontal. The portion of the flexible element 136 between the vertical control guide 142 and the coupling point 148 may be referred to as foot support portion 150. As shown, the foot support portion 150 extends generally vertically when the respective guide link 110 is at the midpoint of its travel. Additionally, the foot support portion 150 remains generally parallel to the respective guide link 110 as they both pivot to allow horizontal travel of the foot receiving area 122. For some embodiments, the elements are considered to be "generally parallel" if they are within twenty five (25) degrees of each other, and in certain embodiments the elements are considered to be "generally vertical" or "generally horizontal" if they are within twenty five (25) degrees of vertical or horizontal, respectively. In some cases, the reference to "generally vertical" or "generally horizontal" refers to the element when it is in the middle of its range of travel. In further embodiments, generally parallel and generally horizontal or vertical means within twenty (20) degrees of absolute and, in still further embodiments, these terms mean that an element is within ten (10) degrees of absolute.

The guide link 110 may be said to have a guide length defined between the first 112 and second 114 attachment points. This length is similar to the length of the foot support portion 150 of the flexible element. The length of the foot support portion of the cable varies with the position of the foot support link 118. In some embodiments, the guide length and the length of the foot support portion 150 are considered to be "similar" if they are within 20% of each other when the foot receiving area is at the midpoint of its vertical travel. In further embodiments, they are within 10% of each other. The described configuration may also provide a parallelogram-type configuration. The first attachment point 112, second attachment point 114, rear guide pulley 145, and coupling point of the cable to the foot support link generally define a parallelogram when the foot support link 118 is at a midpoint of its vertical travel. This parallelogram-type configuration provides a desirable motion profile.

Figure 3A:
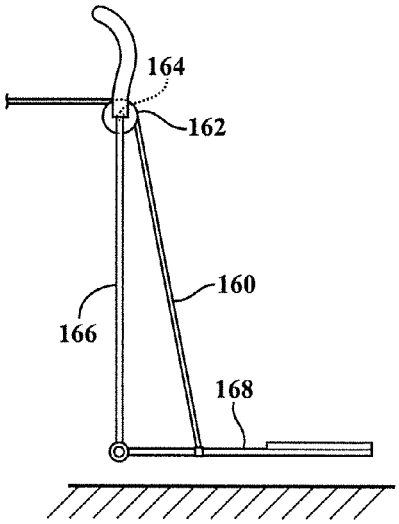
FIGS. 3A-3D are schematic representations of elliptical exercises devices with different geometric configurations.
Figure 3B:
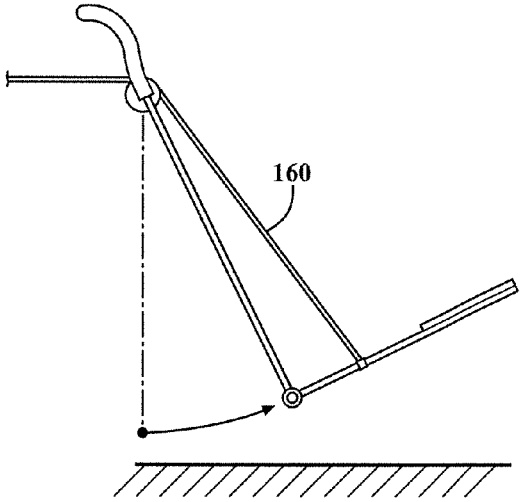
Figure 3C:
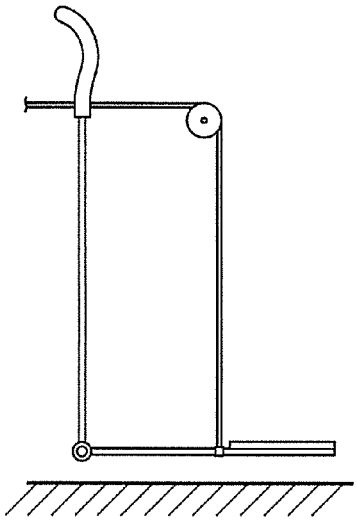
Figure 3D:
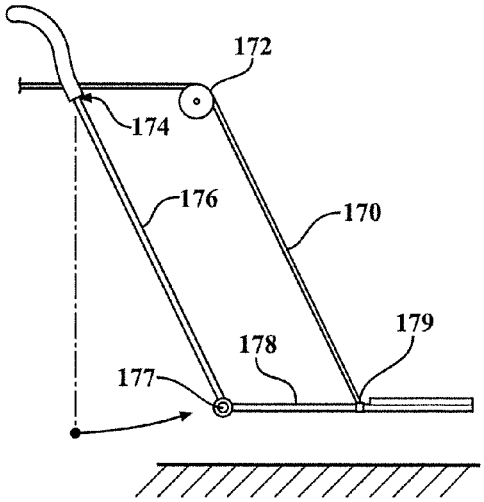

FIGS. 3A-D compare a parallelogram-type configuration to a non-parallelogram-type configuration. In FIGS. 3A and 3B, a flexible element 160 passes over a pulley 162 at the first pivot axis 164, where a guide link 166 is also attached. As shown, if the flexible element 160 is not moved relative to the pulley 162, the foot support link 168 moves through a large angle as the guide link pivots rearwardly. In FIGS. 3C and 3D, a parallelogram-type configuration is used. The flexible element 170 passes over a pulley 172 that is disposed rearwardly of the first pivot axis 174, where the guide link 176 is attached. The distance between the first pivot axis 174 and the pulley 172 is similar to the distance between the connection 177 of the foot support link 178 with the guide link 166 and the coupling point 179. Likewise, the guide length of the guide link 176, between the first and second attachment points, is similar to the length of the foot support portion of the flexible element 170. With this configuration, if the flexible element is not moved relative to the pulley 172, the foot support link 178 remains generally horizontal as the guide link 176 is pivoted rearwardly. This provides a substantial improvement in the motion profile, especially with respect to ankle angle of a user. In some versions, the parallelogram may be distorted somewhat, such as by making the top narrower than the bottom. The definitions of "generally parallel" discussed above may apply to the parallelogram as well. For some versions of the present invention, it is preferred that the vertical control guide be positioned a substantial distance rearward of the first pivot axis 108 to provide a desirable motion profile. For certain versions, a "substantial distance" is defined as 6 or more inches, with the distance being measured from the first pivot axis 108 to an axis of the guide 142, such as the pivot axis of the pulley. On further versions, the distance may be significantly larger than 6 inches.

As with other free stride versions, the horizontal motion may include a mechanism to provide equal and opposite motion. This may take the form of a horizontal coordination linkage linking the first guide link to the second guide link such that pivotal movement of one of the guide links in a first direction causes pivotal movement of the other of the guide lines in an opposite direction. One version of such a mechanism is shown in FIGS. 4 and 5. FIG. 4 provides a side view of a portion of an exercise device, with the vertical control mechanism of FIGS. 1 and 2 removed to simplify the drawing. FIG. 5 provides a top view of the horizontal control mechanism by itself. A horizontal rocker link 180 has a midportion 182 pivotally connected to the frame 102. A left horizontal control link 184 interconnects the left guide link 110 with one end of the rocker link 180 and a right horizontal control link 186 interconnects the right guide link with the other end of the rocker link. A second flywheel and resistance element may be coupled to or associated with the horizontal control mechanism.

Figure 6A:
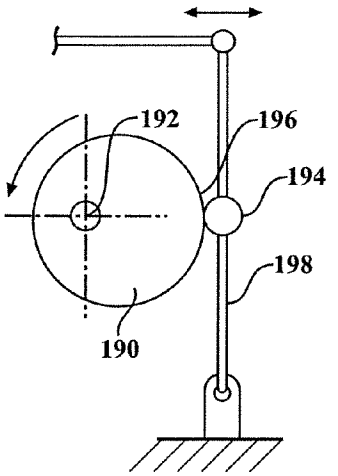
FIG. 6A is a schematic illustration of a cam supported for rotation about a cam axis and a follower in contact with an outer surface of the cam.
Figure 6B:
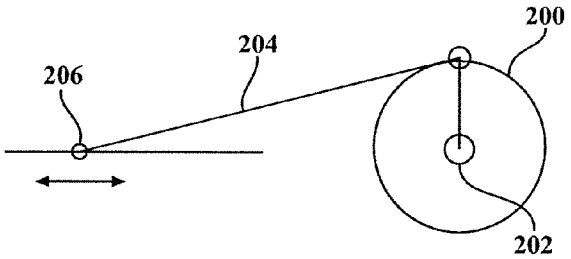
FIG. 6B is a schematic illustration of a typical crank system with a crank supported for rotation about a crank axis.
Figure 6C:
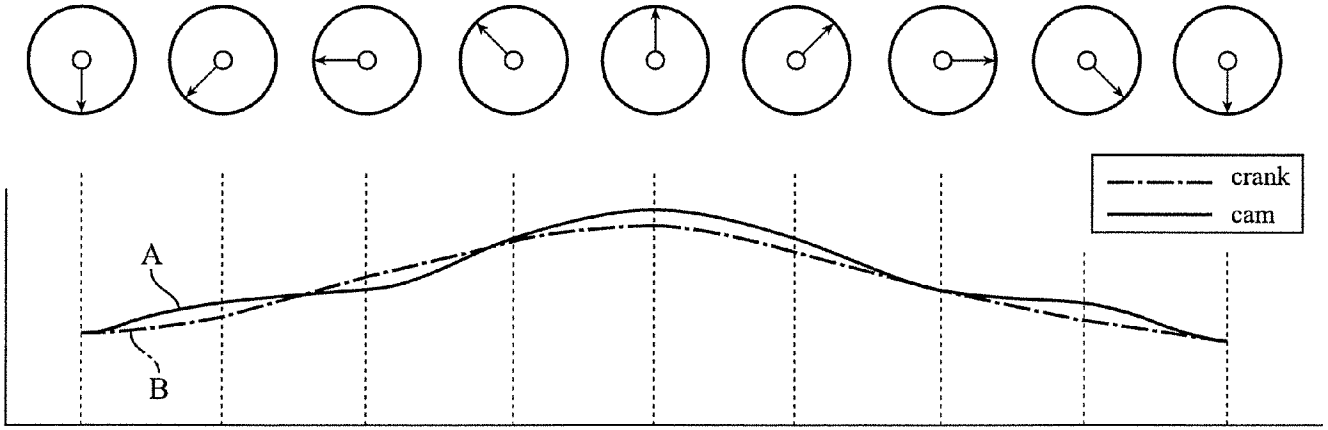
FIG. 6C is a graph comparing the motion caused by an exemplary cam/follower system and a crank system.

The use of a cam allows for a variety of motion profiles. FIG. 6A schematically illustrates a cam 190 supported for rotation about a cam axis 192. In this example, the cam has a circular shape but the circular cam has its center offset from the axis of rotation such that a follower 194 in contact with the outer surface 196 of the cam is oscillated back and forth with respect to the cam axis 192. A pivoting arm 198 is shown supporting the follower 194. FIG. 6B schematically illustrates a typical crank system with a crank 200 supported for rotation about a crank axis 202. A connecting rod or member 204 is connected to an outer point on the crank 200 such that as the crank rotates, an opposite end 206 of the connecting member 204 moves back and forth with respect to the crank axis 202. FIG. 6C compares the resulting motion of the follower 194 (curve A) and connecting member end 206 (curve B) as the respective cam and crank rotate. As shown, the resulting motion profile is not the same. The use of the cam provides a different result than the crank system and provides a different motion profile. As shown, the cam motion profile is not symmetrical with respect to top dead center (TDC). This motion profile provides certain advantages with respect to the resulting motion profile of the exercise device. The use of a cam and follower also allows flexibility in the range of motion, by altering the length and positioning of the pivoting arms.

Figure 7A:
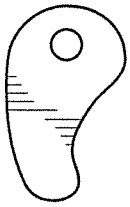
FIG. 7A-C are drawings of exemplary alternative cam shapes that may be used with certain versions of the present invention.
Figure 7B:
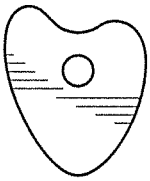
Figure 7C:
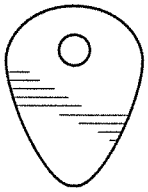
Figure 8:
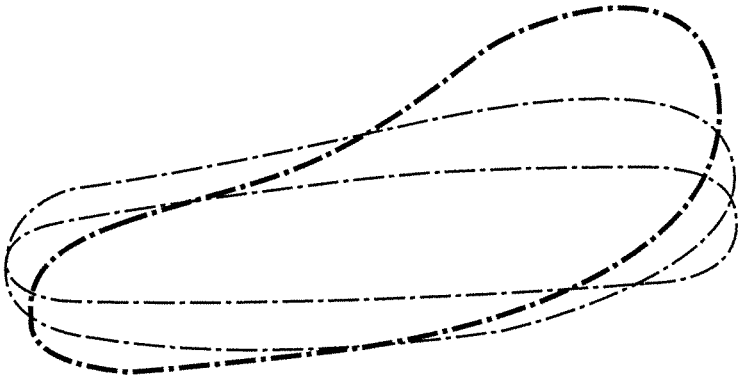
FIG. 8 is a schematic representation of several exemplary foot motion profiles that may be achieved through the use of different cam shapes.

FIGS. 7A-7C show examples of alternative cam shapes to illustrate the flexibility of using a cam. The cam shape shown in FIG. 6A may be referred to as a circular cam while other shapes, including those in FIGS. 1, 2 and 7A-7C, may be referred to as a non-circular cam. FIG. 8 shows several exemplary foot motion profiles that may be achieved through the use of different cam shapes.

Figure 9:
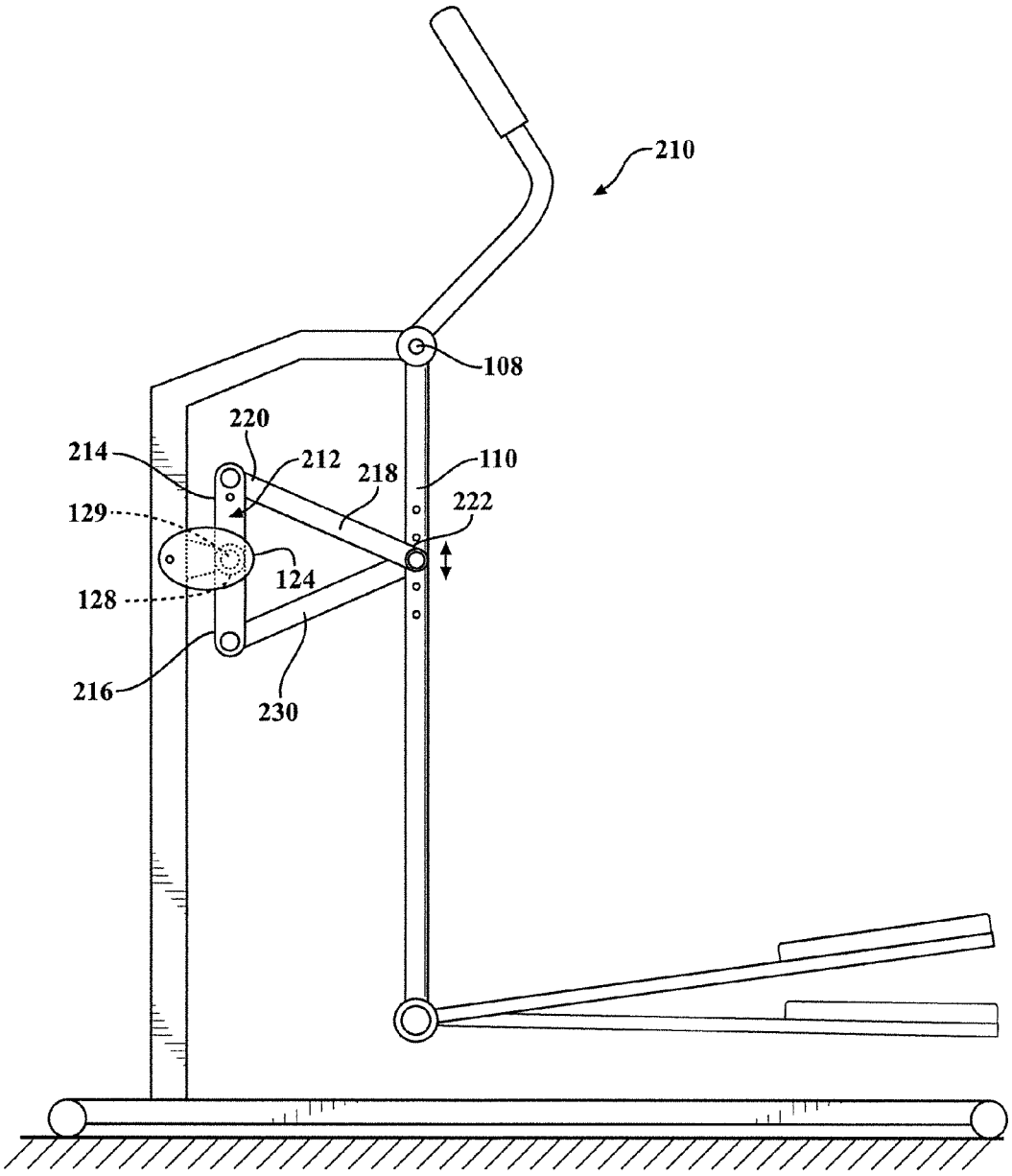
FIG. 9 is a side elevational view of a portion of another embodiment of an elliptical exercise device in accordance with the present invention.

The free stride version of FIGS. 1 and 2 may be modified to provide a fixed path version by adding a mechanism for controlling horizontal motion. The coordinating mechanism of FIGS. 4 and 5 may then we removed. FIG. 9 shows a portion of an exercise device 210 with the most of the vertical control mechanism of FIGS. 1 and 2 removed to simplify the drawing. A cam 124 is illustrated, as before, but a horizontal control crank 212 is added. In this version, the crank 212 is supported for rotation about the same axis 129 as the cam 124, and may be supported on the same shaft 128. Alternatively, the cam drive and crank may be separate. The crank 212 may have a pair of arms 214 and 216 that are 180 degrees opposed. A first horizontal control link 218 has a first end 220 attached to the outer end of the first crank arm 214 and a second end 222 attached to the guide link 110 below the first pivot axis 108. Likewise, a second horizontal control link 230 interconnects the second crank arm 216 with the second guide link. As the crank 212 and cam 194 rotate about the cam axis 129, the crank arms cause the guide links to pivot about the first pivot axis, thereby causing the foot receiving areas of the foot support links to move in a path of travel having a horizontal component of motion. As will be clear to those of skill in the art, the horizontal and vertical motions are substantially out of phase such that when the horizontal component of motion of each foot receiving area is at its forwardmost or rearwardmost limit, the vertical component of motion of the same foot receiving area is approximately midway between its uppermost and lowermost limit. The motions are considered to be substantially out of phase if they are within twenty five degrees (25) of absolute out of phase.

As shown, the attachment point between each link 218 and 230 and the respective crank may be adjustable to adjust the amount of horizontal travel. Alternatively or additionally, the attachment point between each link at the respective guide link may be adjustable to adjust the amount of horizontal travel. These adjustments may be manual, as shown, or powered in various ways, including the approach discussed below for adjusting the range of vertical travel.

FIGS. 10 and 11 show an exercise device 300 similar to the device of FIGS. 1 and 2, but with the addition of an adjustment mechanism for adjusting the vertical travel of the stride path. Otherwise, the device 300 is the same as in FIGS. 1 and 2 and the same numbers will be used for the constituent elements. FIG. 10 provides a side view of the exercise device and FIG. 11 provides a top view of the pivoting arms with an adjustment mechanism. A left collar 302 and right collar 304 are slidably coupled to a left pivoting arm 306 and a right pivoting arm 308, respectively. By adjusting the position of the collar on the respective pivoting arm, the range of vertical travel can be adjusted. The left collar 302 defines the control end and connection point 310 for the flexible element 136. By adjusting the position of the collar 302, the range of travel of the control end 310 is adjusted, thereby adjusting the range of vertical travel. As best shown in FIG. 11, an actuator 312 is connected to the collars 302 and 304 by connecting rods or cables 314 and 316, respectively. The actuator moves the collar locations to change the amount of vertical motion of both foot receiving areas. Springs may be used to bias the collars against the adjusting mechanism.

Figure 12:
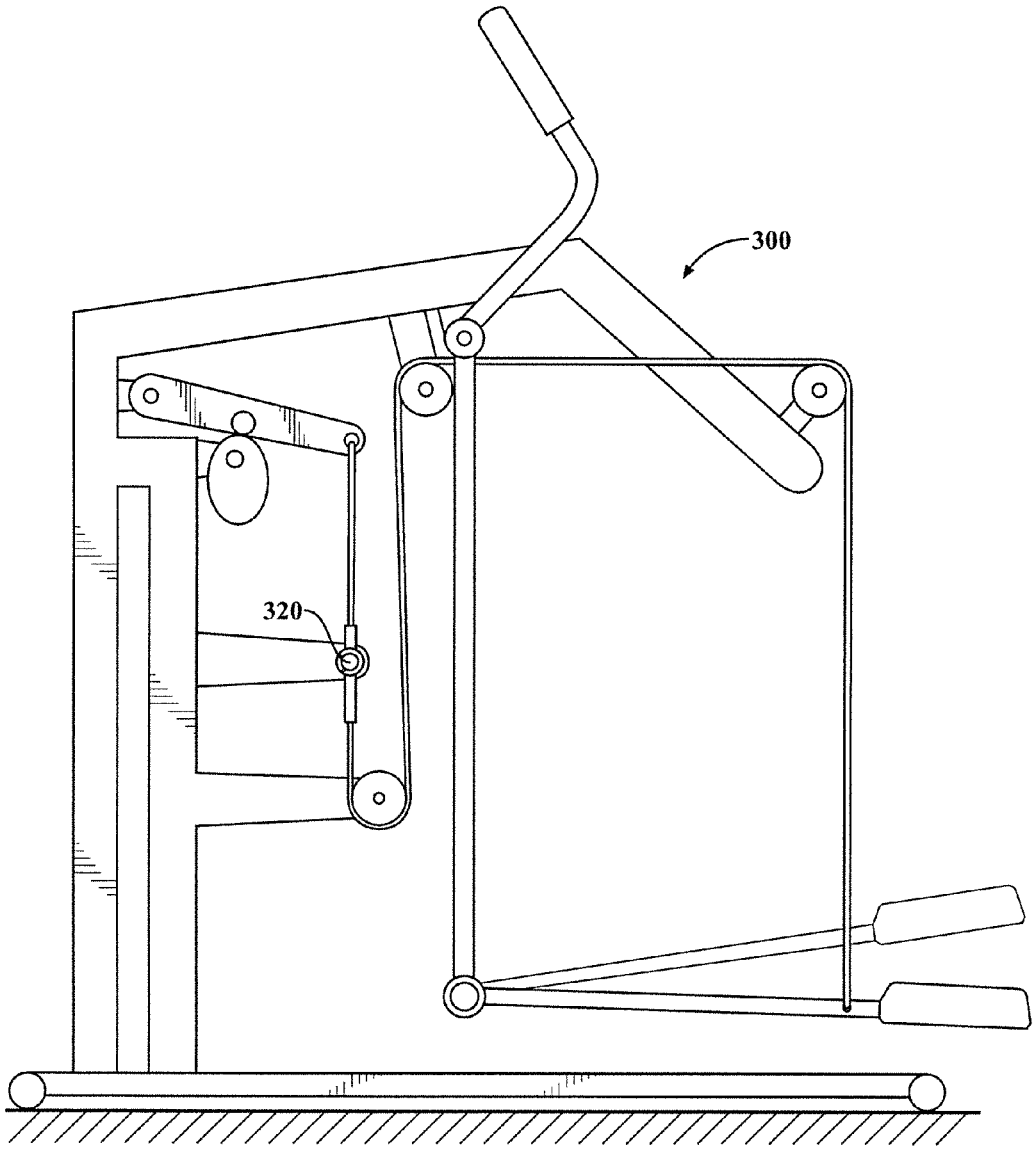
FIG. 12 is a side elevational view of yet another embodiment of an exercise device according to the present invention, having a different adjustment mechanism.
Figure 13:
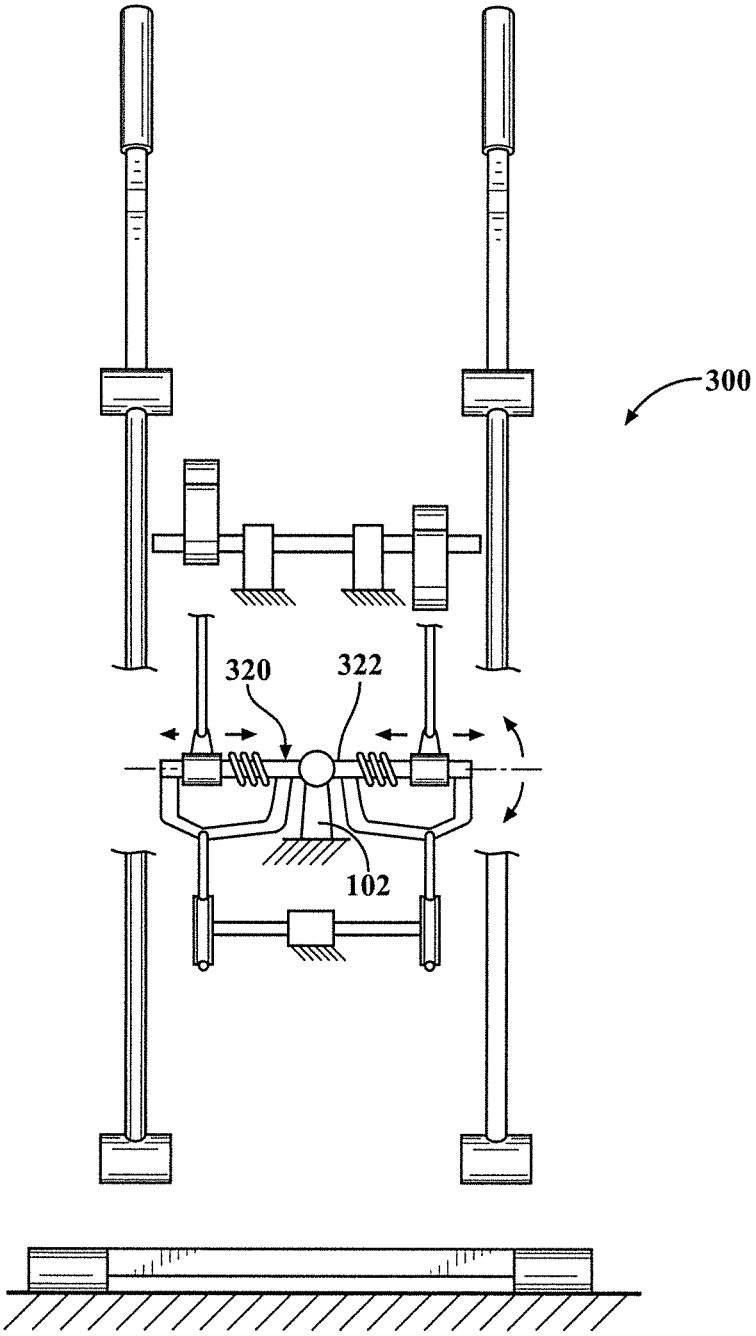
FIG. 13 is a front view of a portion of the exercise device of FIG. 12 showing the adjustment mechanism.

FIGS. 12 and 13 show another method of adjusting the vertical travel; FIG. 12 is a side view of a portion of an exercise device 300 and FIG. 13 is a front view of a portion of the device. A pivoting member 320 has a midportion 322 pivotally attached to the frame 102. A left collar 324 and right collar 326 move inwardly and outwardly relative to the midportion 322 causing the amount of vertical motion to change. Not shown is an actuator and cables that would cause the in and out motion.

Figure 14:
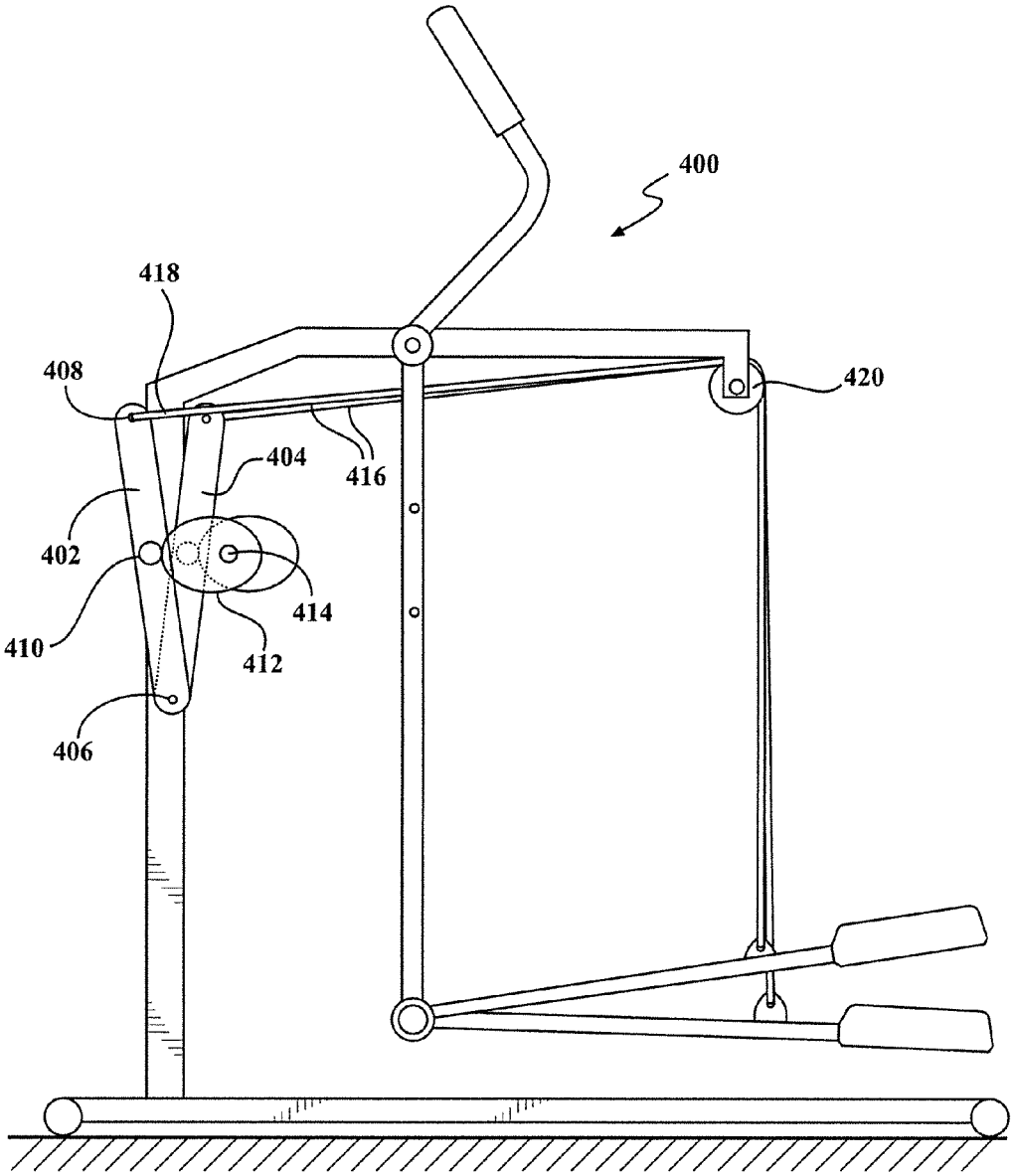
FIG. 14 is a side elevational view of an alternative embodiment of an exercise device according to the present invention.

FIG. 14 shows an alternative version of a free stride elliptical exercise device 400. The device 400 differs from the embodiment of FIGS. 1 and 2 in the orientation of the pivoting arms 402 and 404. As shown, the pivoting arm 402 has a pivot end 406 at a lower end and extends generally vertically (at a midpoint of travel) to an upper end 408 that defines the control end. A follower 410 in the midportion of the arm 402 engages an outer surface of a cam 412 such that rotation of the cam 412 about the axis of rotation 414 causes the control end 408 to oscillate forwardly and rearwardly. In the illustrated embodiment, the cams are non-circular, and generally oval or ellipsoidal in shape. The flexible element 416 has a first end 418 coupled to the control end 408 of the pivoting arm 402 and then extends generally horizontally and rearwardly to the vertical control pulley 420, then downwardly to the foot support link. The device 400 may include a horizontal coordination linkage, such as shown in FIGS. 4 and 5.

Figure 15:
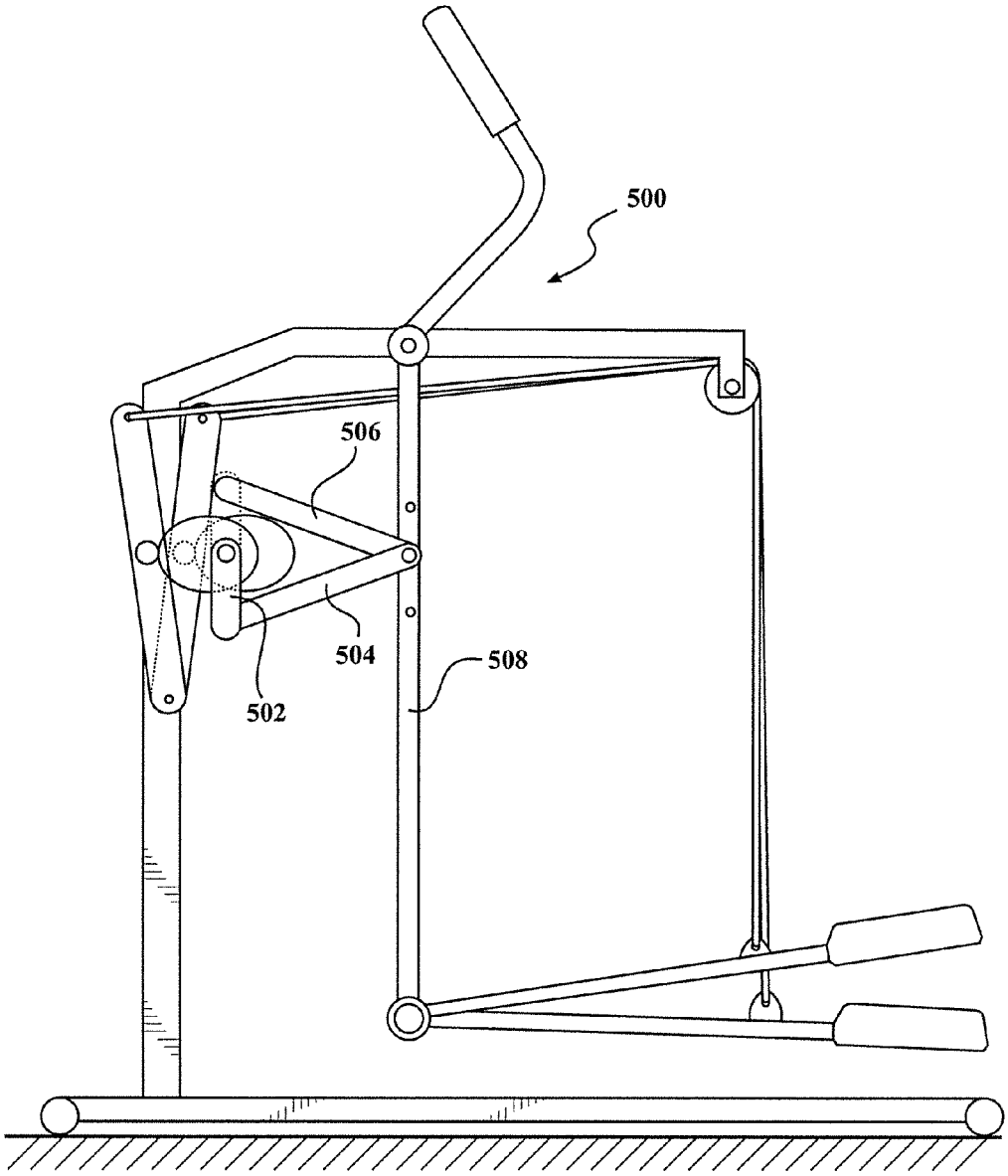
FIG. 15 is a side elevational view of a further alternative embodiment of an exercise device according to the present invention.

FIG. 15 illustrates a further alternative version of an elliptical exercise device 500, similar to the version of FIG. 14 but with horizontal control linkages. The device 500 adds a crank 502 and first and second horizontal control links 504 and 506 which couple the guide links to the crank. As shown, guide link 508 is coupled to the crank by horizontal control link 504. The device does not require the linkage of FIGS. 4 and 5 but it otherwise the same as the device 400 in FIG. 14.

As will be clear to those of skill in the art, the embodiments of the present invention illustrated and discussed herein may be altered in various ways without departing from the scope or teaching of the present invention. Also, elements and aspects of one embodiment may be combined with elements and aspects of another embodiment. It is the following claims, including all equivalents, which define the scope of the invention.

The invention claimed is:

1. An elliptical exercise device comprising:

a frame configured to be supported on a horizontal surface, the frame having a first pivot axis defined thereon, the frame further having a forward portion forward of the first pivot axis and a rearward portion rearward of the first pivot axis;

a first and a second guide link each having a first and a second attachment point defined thereon, each guide link being pivotally attached, through its first attachment point, to the frame at the first pivot axis thereof, each of the guide links having a guide length defined between the first and second attachment point;

a first and a second foot support link each having a foot receiving area configured to support a user's foot thereupon, each foot support link being pivotally connected to the second attachment point of a respective one of the guide links so that when the guide links pivot relative to the frame, they each cause the respective foot receiving area to move in a path of travel having a horizontal component of motion, each foot support link further having a coupling point rearward of the respective pivotal connection to the respective guide link;

a cam drive having a first and second cam supported for rotation about an axis of rotation and a first and a second pivoting arm engaging the respective first and second cams such that rotation of the cams causes movement of the pivoting arms;

a first and a second vertical control guide disposed on the rearward portion of the frame, spaced from the first pivot axis;

a first and a second flexible element each coupling a respective one of the foot support links to a respective one of the pivoting arms of the cam drive, each flexible element having a first end connected to a respective one of the pivoting arms, a second end connected to the coupling point on the respective foot support link, and a midportion extending over a respective one of the vertical control guides on the frame such that rotation of the cams moves the foot receiving areas of the respective foot support links in a path of travel having a vertical component of motion;

each of the flexible couplings having a foot support portion extending between the coupling point on the respective foot support link and the respective vertical guide on the frame, the foot support portion being generally parallel to the respective guide link throughout the motion of the device, the foot support portion further having a length that is similar to the guide length when the respective foot support link is at a midpoint of vertical travel; and the respective first attachment point, second attachment point, vertical control guide on the frame and coupling point on the foot support portion generally define a parallelogram when the respective foot support link is at the midpoint of vertical travel;

wherein the pivotal motion of the guide links about the first attachment points is decoupled from the motion of the foot receiving areas along the path of travel having a vertical component of motion so that the user can achieve a foot path that is generally vertical or a blend of vertical and horizontal motion.

2. An elliptical exercise device in accordance with claim 1, wherein the vertical control guides are spaced from the first pivot axis by a distance of 6 or more inches.

3. An elliptical exercise device in accordance with claim 1, wherein each of the cams has a generally non-circular shape.

4. An elliptical exercise device in accordance with claim 1, wherein the guide links further comprise hand portions extending upwardly from the first attachment point.

5. An elliptical exercise device in accordance with claim 1, wherein:

a forward end of each foot support link is pivotally interconnected with the second attachment point of the respective guide link and a rearward end of each foot support link defines the foot receiving area; and the coupling point on each foot support link being defined between the forward and rearward ends.

6. An elliptical exercise device in accordance with claim 1, wherein the pivoting arms each have a pivot end, an opposite control end, and a midportion therebetween, the pivot arms each further having a follower connected to the midportion, each follower contacting an outer surface of a respective one of the cams, the first end of each of the flexible elements being connected to the control end of the respective one of the pivoting arms.

7. An elliptical exercise device in accordance with claim 6, wherein each pivoting arm is generally horizontal with the pivot end being forward of the control end, each flexible element extending generally vertically from the control end of the respective pivoting arm.

8. An elliptical exercise device in accordance with claim 7, further having a first and second forward pulley and a first and second lower pulley, each flexible element extending downwardly from the first end, wrapping under the respective lower pulley, extending upwardly and wrapping over the forward pulley, and extending rearwardly to the respective vertical control guide.

9. An elliptical exercise device in accordance with claim 6, wherein each pivoting arm is generally vertical with the pivot end being lower than the control end, each flexible element extending generally horizontally and rearwardly from the control end of the respective pivoting arm.

10. An elliptical exercise device in accordance with claim 1, further comprising a horizontal coordination linkage linking the first guide link to the second guide link such that pivotal movement of one of the guide links in a first direction causes pivotal movement of the other of the guide lines in an opposite direction.

11. An elliptical exercise device in accordance with claim 1, wherein each vertical control guide comprises a pulley rotationally mounted on the frame.

12. An elliptical exercise device in accordance with claim 1, further comprising an adjustment mechanism for adjusting a range of vertical travel, the adjustment mechanism comprising a first sliding collar coupled to the first pivoting arm and a second sliding collar coupled to the second pivoting arm, the first end of each of the flexible elements being coupled to the sliding collar of the respective pivoting arm, the adjustment mechanism further comprising an actuator operable to move the sliding collars on the pivoting arms.

13. An elliptical exercise device in accordance with claim 1, wherein the flexible element are cables.

14. An elliptical exercise device comprising:

a frame configured to be supported on a horizontal surface, the frame having a first pivot axis defined thereon, the frame further having a forward portion forward of the first pivot axis and a rearward portion rearward of the first pivot axis;

a first and a second guide link each having a first and a second attachment point defined thereon, each guide link being pivotally attached, through its first attachment point, to the frame at the first pivot axis thereof, each of the guide links having a guide length defined between the first and second attachment point;

a first and a second foot support link each having a foot receiving area configured to support a user's foot thereupon, each foot support link being pivotally connected to the second attachment point of a respective one of the guide links so that when the guide links pivot relative to the frame, they each cause the respective foot receiving area to move in a path of travel having a horizontal component of motion, each foot support link further having a coupling point rearward of the respective pivotal connection to the respective guide link;

a cam drive having a first and second cam supported for rotation about an axis of rotation and a first and a second pivoting arm engaging the respective first and second cams such that rotation of the cams causes movement of the pivoting arms;

a first and a second vertical control guide disposed on the rearward portion of the frame, the vertical control guides being spaced from the first pivot axis by a distance of 6 or more inches;

a first and a second flexible element each coupling a respective one of the foot support links to a respective one of the pivoting arms of the cam drive, each flexible element having a first end connected to a respective one of the pivoting arms, a second end connected to the coupling point on the respective foot support link, and a midportion extending over a respective one of the vertical control guides on the frame such that rotation of the cams moves the foot receiving areas of the respective foot support links in a path of travel having a vertical component of motion;

wherein the pivotal motion of the guide links about the first attachment points is decoupled from the motion of the foot receiving areas along the path of travel having a vertical component of motion so that the user can achieve a foot path that is generally vertical or a blend of vertical and horizontal motion.

15. An elliptical exercise device in accordance with claim 14, wherein each of the cams has a generally non-circular shape.

16. An elliptical exercise device in accordance with claim 14, wherein:

a forward end of each foot support link is pivotally interconnected with the second attachment point of the respective guide link and a rearward end of each foot support link defines the foot receiving area; and the coupling point on each foot support link being defined between the forward and rearward ends.

17. An elliptical exercise device in accordance with claim 14, wherein the pivoting arms each have a pivot end, an opposite control end, and a midportion therebetween, the pivot arms each further having a follower connected to the midportion, each follower contacting an outer surface of a respective one of the cams, the first end of each of the flexible elements being connected to the control end of the respective one of the pivoting arms.

18. An elliptical exercise device in accordance with claim 17, wherein each pivoting arm is generally horizontal with the pivot end being forward of the control end, each flexible element extending generally vertically from the control end of the respective pivoting arm.

19. An elliptical exercise device in accordance with claim 18, further having a first and second forward pulley and a first and second lower pulley, each flexible element extending downwardly from the first end, wrapping under the respective lower pulley, extending upwardly and wrapping over the forward pulley, and extending rearwardly to the respective vertical control guide.

20. An elliptical exercise device in accordance with claim 17, wherein each pivoting arm is generally vertical with the pivot end being lower than the control end, each flexible element extending generally horizontally and rearwardly from the control end of the respective pivoting arm.

21. An elliptical exercise device in accordance with claim 14, further comprising a horizontal coordination linkage linking the first guide link to the second guide link such that pivotal movement of one of the guide links in a first direction causes pivotal movement of the other of the guide lines in an opposite direction.

22. An elliptical exercise device in accordance with claim 14, wherein the flexible element are cables.

* * * * *